US005913616A

United States Patent [19]

Galella

[11] Patent Number: 5,913,616

[45] Date of Patent: Jun. 22, 1999

[54] CHEMILUMINESCENT FUNERAL SYMBOL

[76] Inventor: Rodney Galella, 885A Conklin St., Farmingdale, N.Y. 11735

[21] Appl. No.: 08/905,853

[22] Filed: Aug. 4, 1997

[51] Int. Cl.[6] ..... G09F 13/24

[52] U.S. Cl. ..... 40/542; 40/593; 40/617; 362/34; 362/121; 362/49.4; 362/806

[58] Field of Search ..... 40/542, 593, 617, 40/757, 564, 638; 362/29, 34, 121, 49.4, 806; 240/230.8; 24/198, 169; 63/3.2, 3.1, 1.13

[56] References Cited

U.S. PATENT DOCUMENTS

| | | | |
|---|---|---|---|
| 30,969 | 12/1860 | Hews | 63/3.2 X |
| 1,342,817 | 6/1920 | Kohlhepp | 40/757 X |
| 1,705,407 | 3/1929 | Joffe | 40/638 |
| 2,114,194 | 4/1938 | Sadacca | 362/121 X |
| 4,814,949 | 3/1989 | Elliott | 362/34 |
| 5,067,051 | 11/1991 | Ladyjensky | 362/34 |
| 5,237,766 | 8/1993 | Mikolay | 40/564 |

*Primary Examiner*—Brian K. Green
*Assistant Examiner*—Rodrigo J. Morales
*Attorney, Agent, or Firm*—Michael I. Kroll

[57] ABSTRACT

A chemiluminescent funeral symbol (10) comprising a hollow religious ornament (12). A source of chemiluminescent light (14) is within the hollow religious ornament (12). A structure (16) is for hanging the hollow religious ornament (12) from a rearview mirror (18) within a motor vehicle (20). The hollow religious ornament (12) illuminated by light from the source of chemiluminescent light (14) can be seen through a front windshield (22) of the motor vehicle (20) during a funeral procession.

3 Claims, 6 Drawing Sheets

CHEMILUMINESCENT FUNERAL SYMBOL

BACKGROUND OF THE INVENTION

1. Field of the Invention

The instant invention relates generally to lighting devices and more specifically it relates to a chemiluminescent funeral symbol. The chemiluminescent funeral symbol is a religious ornament which creates a bright iridescent light and is hung from a rearview mirror in a motor vehicle during a funeral procession.

2. Description of the Prior Art

Numerous lighting devices have been provided in prior art. For example, U.S. Pat. No. 4,715,564 to Kinn et al.; U.S. Pat. No. 5,043,851 to Kaplan; U.S. Pat. No. 5,325,273 to Kuo; U.S. Pat. No. 5,557,869 to Douglas and U.S. Pat. No. 5,564,816 to Arcadia et al. all are illustrative of such prior art. While these units may be suitable for the particular purpose to which they address, they would not be as suitable for the purposes of the present invention as heretofore described.

A chemiluminescent kite has a frame including at least one support member, and a cover sheet supported by the frame and adapted to catch the wind. At least one support member of the kite includes at least one self-contained source of chemiluminescent light. The source has an outer flexible container which transmits light and which contains both a first reactive composition and at least one inner breakable container. The inner container contains a second reactive composition which is adapted to react with the first reactive composition to provide chemiluminescent light. The cover sheet may be made of a translucent or transparent material, so that the light is visible through the cover sheet. In addition, the cover sheet may be decorated with an opaque design.

A polygonal outer shell providing improved light transmission characteristics for chemiluminescent lighting devices. The corners created by incidence of the surfaces that comprise the shell create a fiber optic effect by concentrating the light in the corners, thus enhancing visibility of light emanating from the light stick and optimizing the amount and distribution of light radiated from the device. Furthermore, a hook-shaped tip is provided by which the light may be suspended from a means of horizontal support. In an alternate embodiment, the hook defines an opening and a quick release locking device, which allows quick insertion of the means of horizontal support into an eye and simultaneously prevents the support from disengaging therefrom unless the locking device is released.

A lighting bar having an elastic transparent tube with its interior divided with two or more chambers for containing different chemicals separately in the chambers. The elastic tube is able to be bent for forcing a dividing thin film of the chambers to break, so as to let the chemicals mix together to produce light.

An artistic display device includes a shell having a substantially flat front wall through which an optical image is to be transmitted and a rear wall disposed substantially parallel to the front wall. A body of liquid-absorbing material is essentially in the shape of a flat layer. The front and rear walls of the shell have perimetrical portions that are positioned close together in a parallel relationship, with the flat body of liquid-absorbing material having a perimetrical portion that is disposed between and supported by the perimetrical portions of the walls. The rear wall is also rearwardly recessed to form a compartment. At least one set of frangible vials are housed in the compartment containing respectively separate liquids, which vials may be broke, so as to mix the liquids to provide a chemiluminescent light-generating mixture that will then saturate the liquid-absorbing body. The liquid-absorbing body then continuing to be supported from its perimetrical portion in substantially its original flat configuration. A flat light control member disposed between the flat layer of liquid-absorbing material and the front wall of the shell for modifying light, that is then generated from the liquid-absorbing material and transmitted through the front wall.

An illuminated memorial for use at a grave site is comprised of an opaque hollow structure that defines an interior chamber. An aperture extends into the hollow structure exposing a portion of the hollow chamber. The hollow structure itself is preferably formed from metal and is shaped and reinforced in its structure to resist physical damage from vandals. A light source is contained within the hollow structure proximate the aperture, whereby light emitted by the light source is directed through the aperture. The light source is powered by at least one rechargeable battery. A photovoltaic source is supported at the highest point of the hollow structure. The photovoltaic source converts light into electricity and recharges the rechargeable batteries during daylight conditions.

SUMMARY OF THE INVENTION

The purpose of the chemiluminescent funeral symbol would be to clearly and safely designate the size and existence of a funeral procession. The funeral procession is currently obscured due to the advent in many motor vehicles of daytime headlights and laws requiring the use of headlights under certain weather conditions. Headlights are the former recognized method of marking funeral processions. A chemiluminescent funeral symbol would be distributed by the funeral home to each motor vehicle in the funeral procession. The chemiluminescent funeral symbol would be activated and then suspended from a rearview mirror in each motor vehicle by a ribbon which is attached thereto.

A primary object of the present invention is to provide a chemiluminescent funeral symbol that will overcome the shortcomings of the prior art devices.

Another object is to provide a chemiluminescent funeral symbol that is in the shape of a religious ornament, which creates a bright iridescent light and can be hung from a rearview mirror in a motor vehicle to be seen through the front windshield during a funeral procession.

An additional object is to provide a chemiluminescent funeral symbol in which an adjustable length ribbon is utilized to hang the religious ornament from the rearview mirror in the motor vehicle.

A further object is to provide a chemiluminescent funeral symbol that is simple and easy to use.

A still further object is to provide a chemiluminescent funeral symbol that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
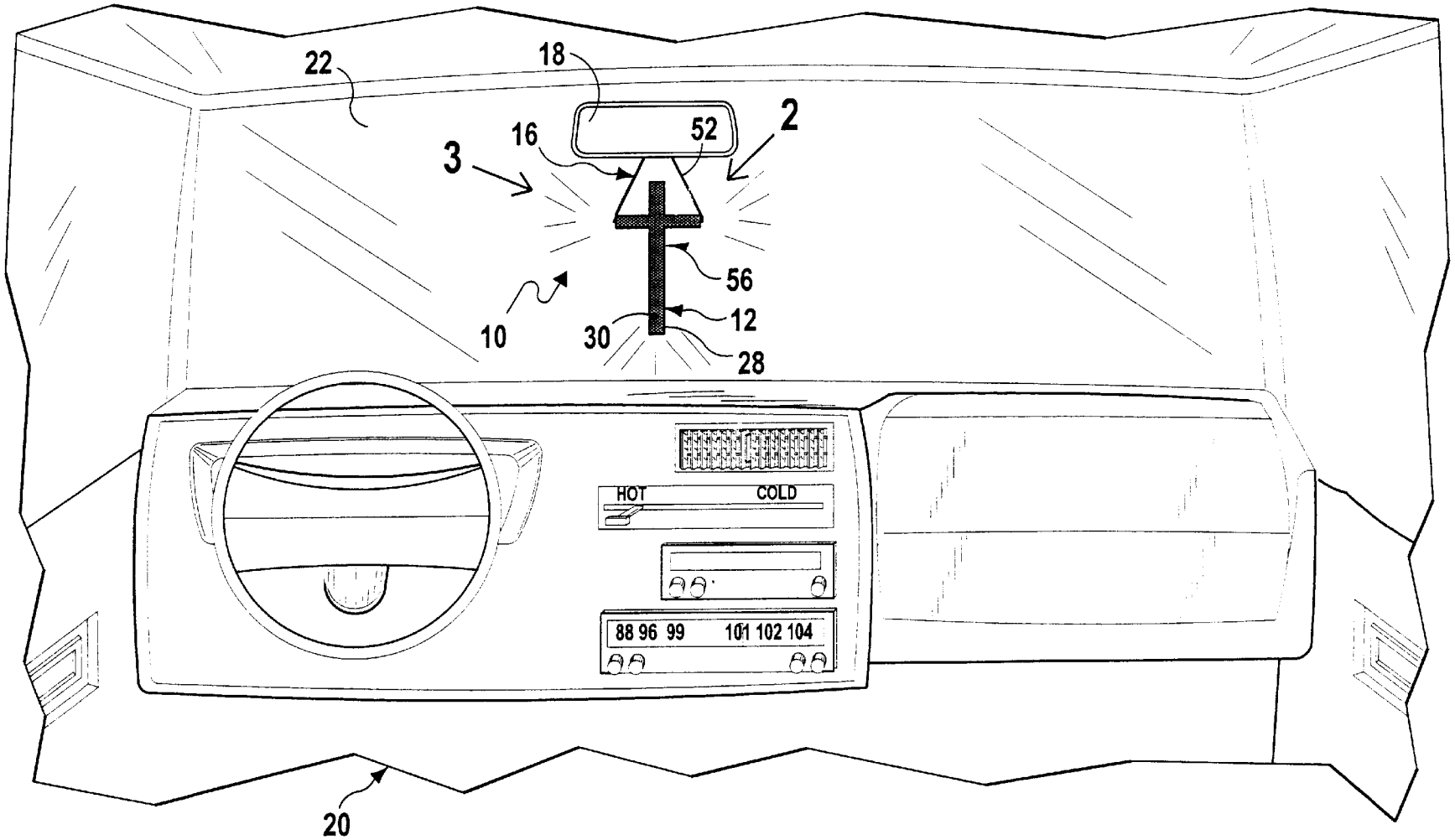
FIG. 1 is a rear elevational view of a first embodiment of the instant invention being displayed from a rearview mirror within a motor vehicle.
Figure 2:
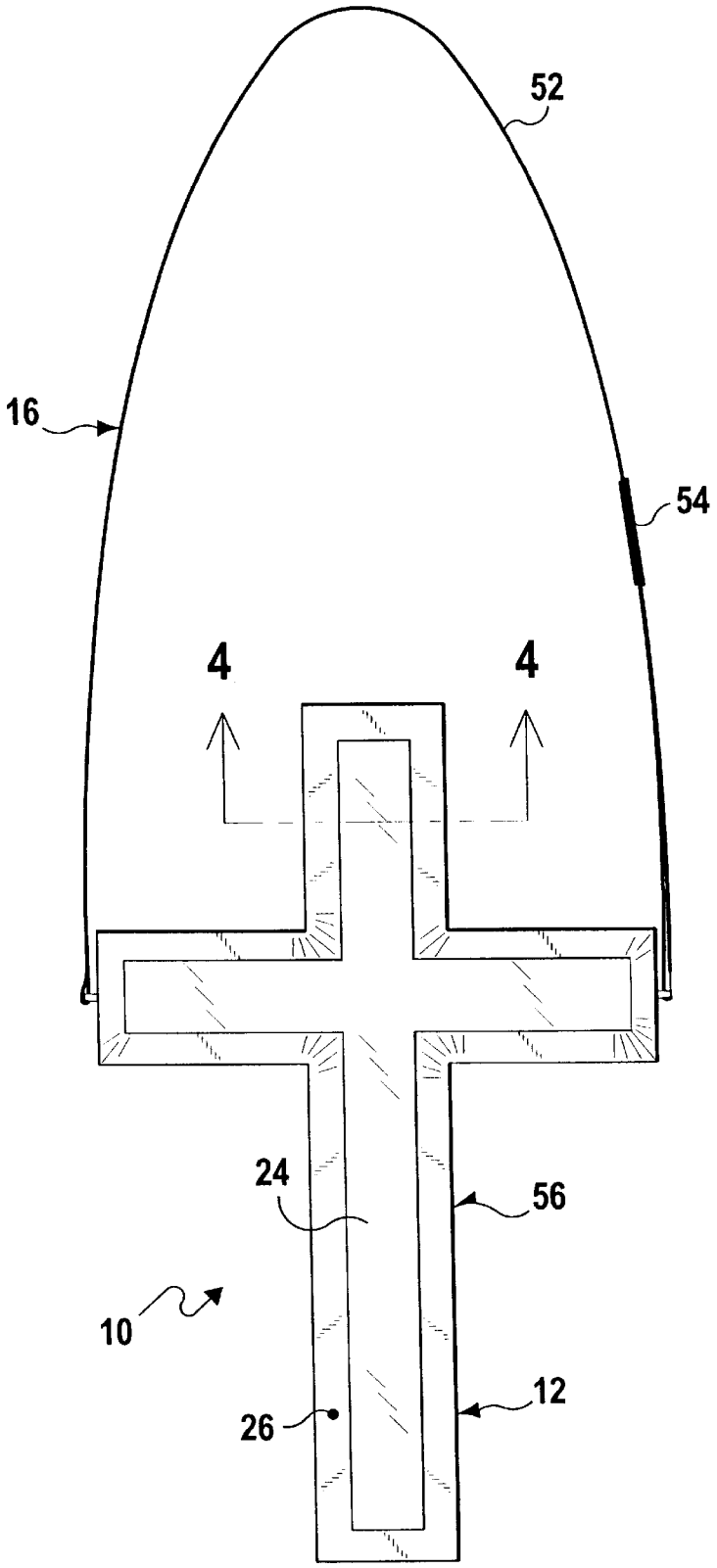
FIG. 2 is an enlarged front elevational view of the first embodiment per se, taken in the direction of arrow 2 in FIG. 1.
Figure 3:
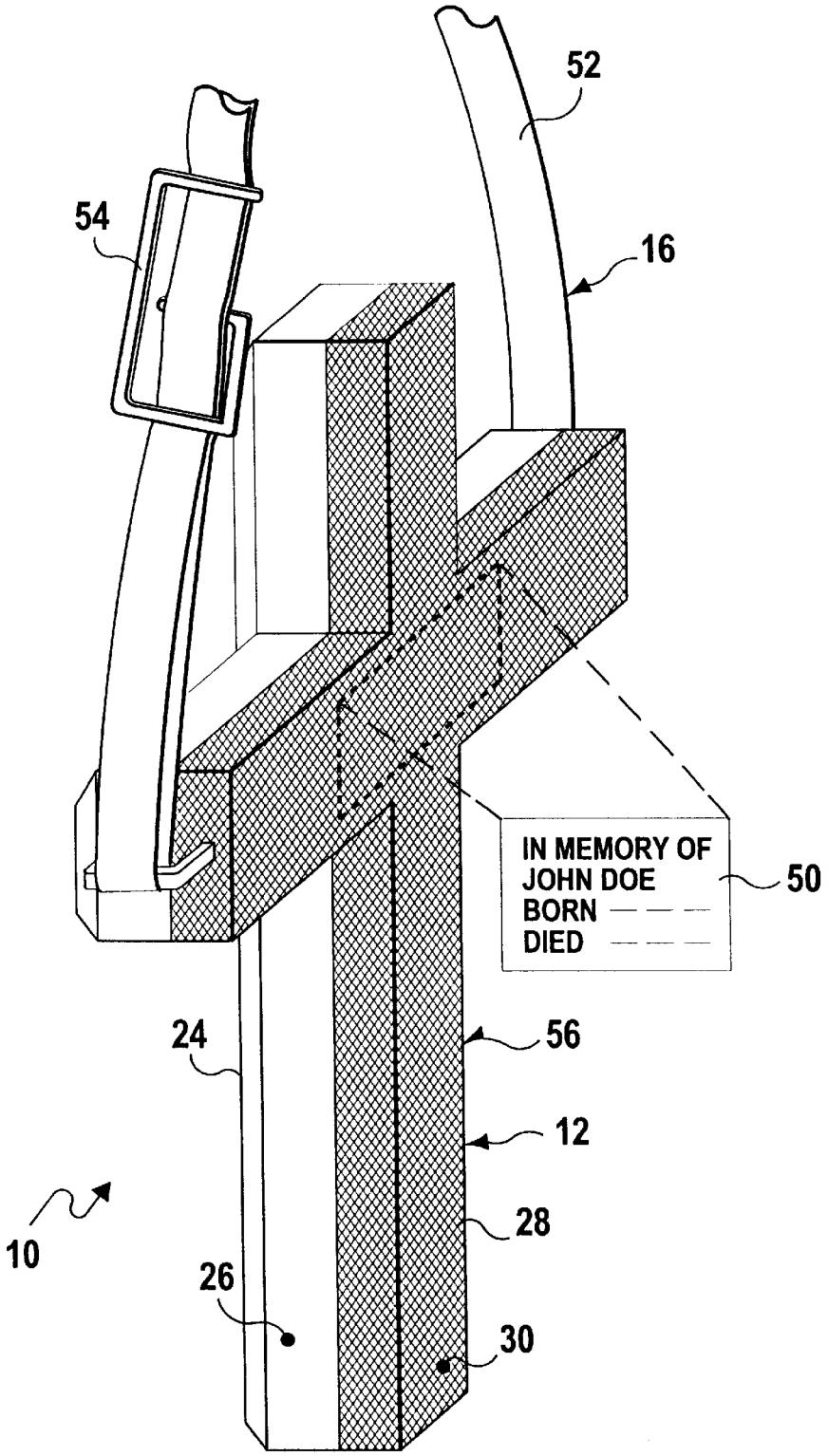
FIG. 3 is an enlarged rear perspective view of the first embodiment per se, taken in the direction of arrow 3 in FIG. 1, showing the ribbon broken away and location of the memorial sticker.

Turning now descriptively to the drawings, in which similar reference characters denote similar elements throughout the several views, FIGS. 1 through 6 illustrate a chemiluminescent funeral symbol 10 of the present invention. With regard to the reference numerals used, the following numbering is used throughout the various drawing figures.

| | |
|---|---|
| 10 | chemiluminescent funeral symbol |
| 12 | hollow religious ornament of 10 |
| 14 | source of chemiluminescent light in 12 of 10 |
| 16 | hanging structure for 12 of 10 |
| 18 | rearview mirror in 20 |
| 20 | motor vehicle |
| 22 | front windshield of 20 |
| 24 | longitudinal front portion of 12 |
| 26 | translucent material for 24 |
| 28 | longitudinal rear portion of 12 |
| 30 | opaque material for 28 |
| 32 | first reactive chemical of 14 |
| 34 | second reactive chemical of 14 |
| 36 | elastic plastic material for 12 |
| 38 | central membrane partition in 12 |
| 40 | first chamber in 12 for 32 |
| 42 | second chamber in 12 for 34 |
| 44 | reflective material on 46 |
| 46 | interior surface of 48 |
| 48 | rear wall of 12 |
| 50 | memorial sticker of 10 |
| 52 | ribbon of 16 |
| 54 | adjustment clip on 52 of 16 |
| 56 | Christian cross for 12 |
| 58 | Jewish star for 12 |

The chemiluminescent funeral symbol 10 comprises a hollow religious ornament 12. A source of chemiluminscent light 14 is within the hollow religious ornament 12. A structure 16 is for hanging the hollow religious ornament 12 from a rearview mirror 18 within a motor vehicle 20. The hollow religious ornament 12 illuminated by light from the source of chemiluminescent light 14 can be seen through a front windshield 22 of the motor vehicle 20, during a funeral procession.

The hollow religious ornament 12 includes a longitudinal front portion 24 fabricated out of a translucent material 26, to allow the light from the source of chemiluminescent light 14 to pass therethrough, so that the hollow religious ornament 12 can be better seen through the front windshield 22 of the motor vehicle 20. A longitudinal rear portion 28 is fabricated out of an opaque material 30, to prevent the light from the source of chemiluminescent light 14 to shine into the eyes of people sitting within the motor vehicle 20.

Figure 4:
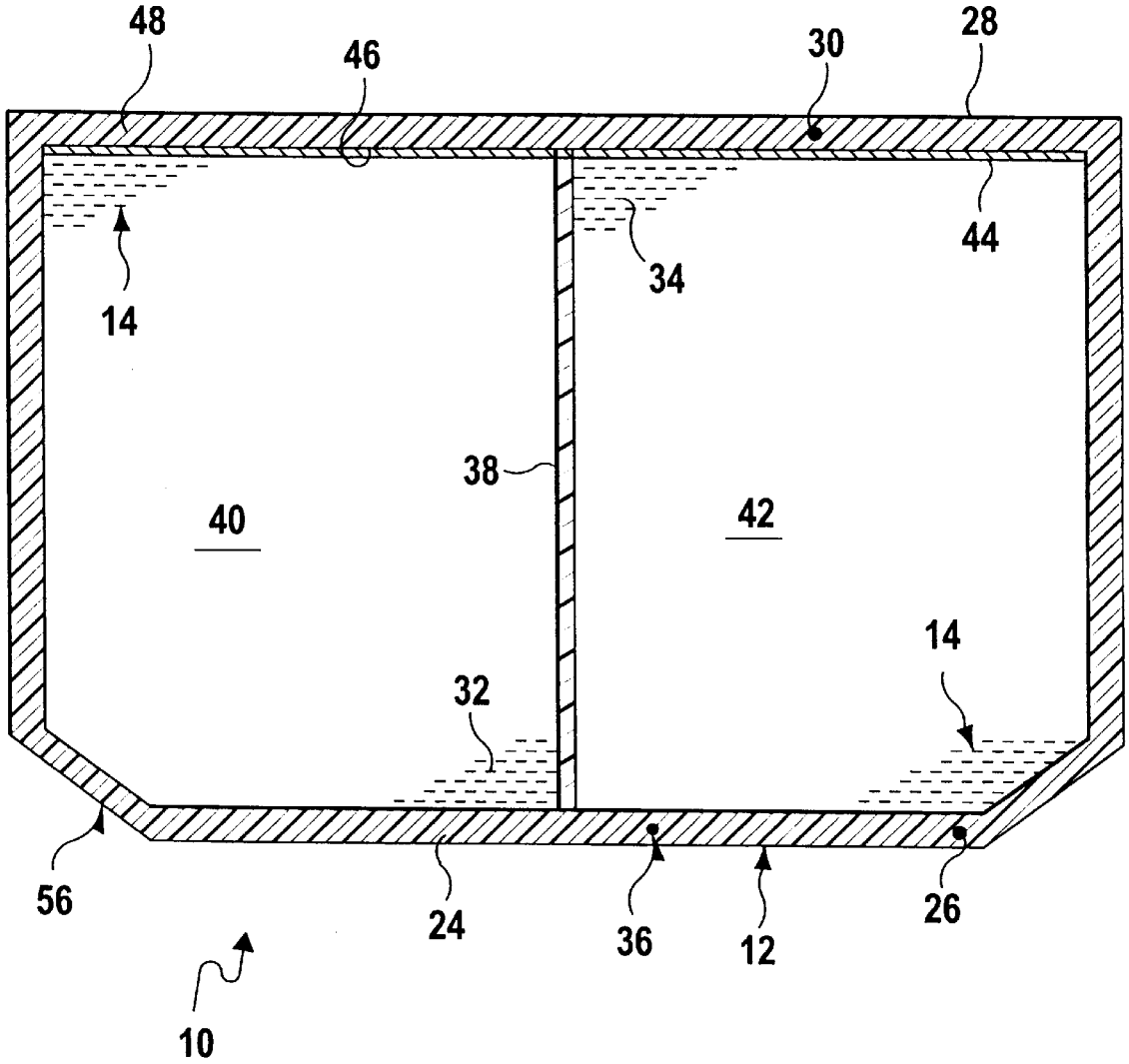
FIG. 4 is an enlarged cross sectional view taken along line 4—4 in FIG. 2.
Figure 5:
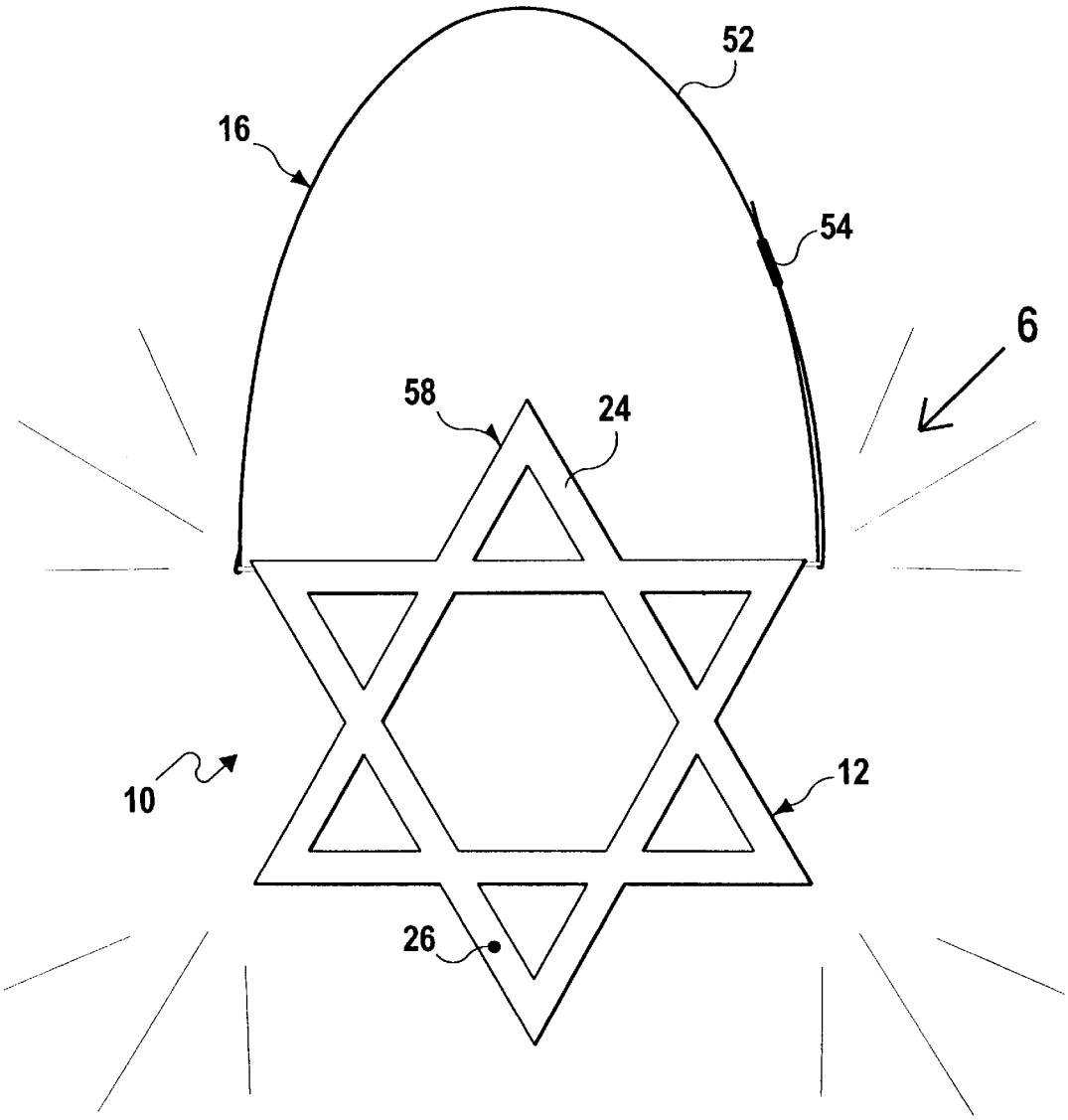
FIG. 5 is a front elevational view of a second embodiment of the instant invention.
Figure 6:
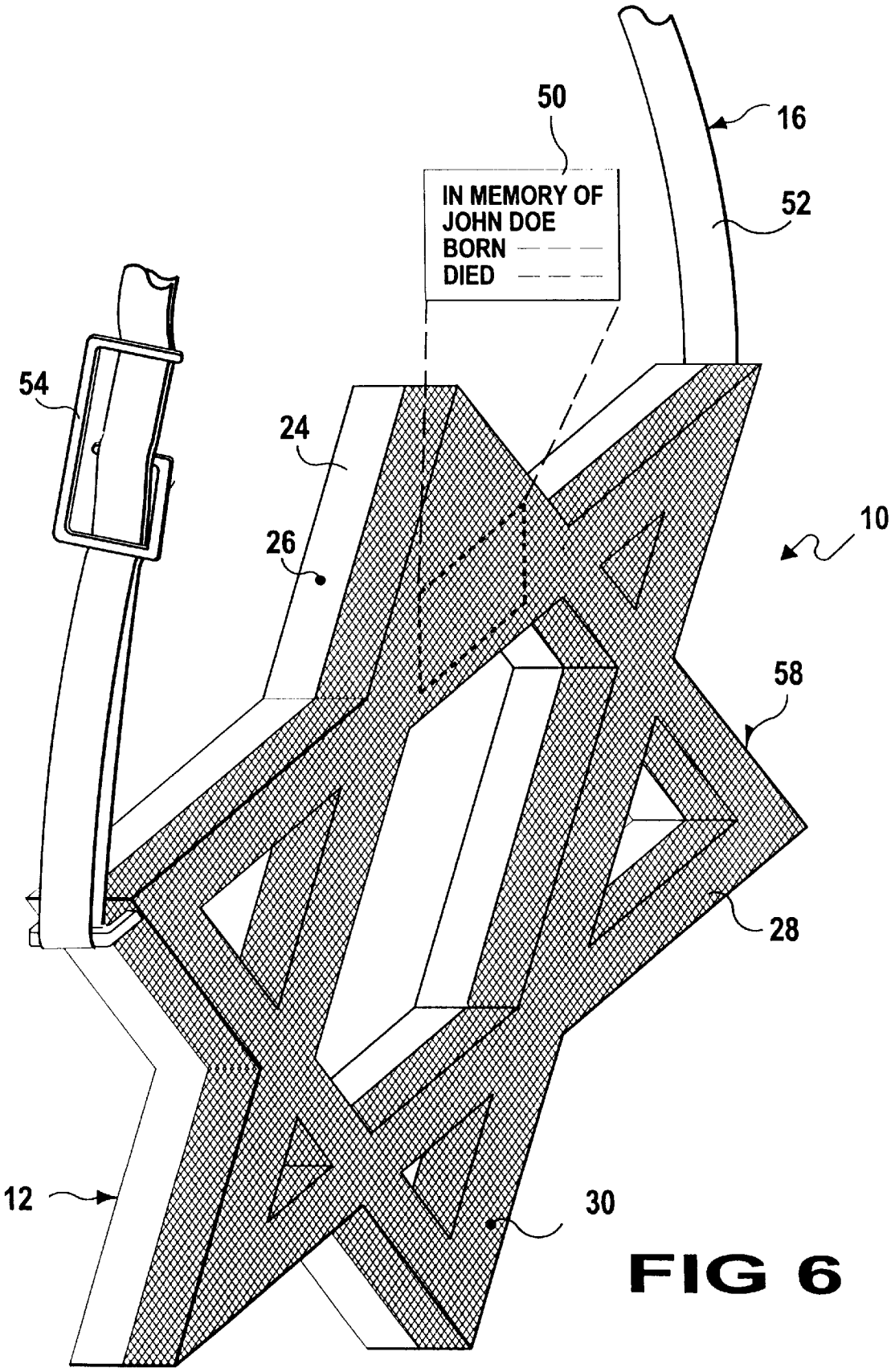
FIG. 6 is an enlarged rear perspective view of the second embodiment taken in the direction of arrow 6 in FIG. 5, showing the ribbon broken away and location of the memorial sticker.

The source of chemiluminescent light 14, as shown in FIG. 4, consists of a first reactive chemical 32. A second reactive chemical 34 is adapted to react within the first reactive chemical 32, to produce the light.

The hollow religious ornament 12, as shown in FIG. 4, is fabricated out of an elastic plastic material 36, to allow the hollow religious ornament 12 to flex. The hollow religious ornament 12 includes a central membrane partition 38 extending longitudinally therein, to form two separate chambers 40 and 42. The first reactive chemical 32 is held within the first chamber 40 and the second reactive chemical 34 is held within the second chamber 42. When the hollow religious ornament 12 is flexed, the central membrane partition 38 will break, to allow the first reactive chemical 32 to mix with the second reactive chemical, to produce the light.

The hollow religious ornament 12 further contains reflective material 44 applied onto an interior surface 46 of a rear wall 48, to reflex the light produced therein out through the front portion 24 of the hollow religious ornament 12. A memorial sticker 50, shown in FIGS. 3 and 6, can be applied to the longitudinal rear portion 28 of the religious ornament 12, to identify the deceased person in the funeral procession.

The hanging structure 16 is a ribbon 52 affixed to the hollow religious ornament 12, in which the ribbon 12 is looped over the rearview mirror 18 within the motor vehicle 20. The hanging structure 16 further includes an adjustment clip 54 on the ribbon 52, to vary the length of the ribbon with respect to the rearview mirror 18.

The hollow religious ornament 12 can be shaped as a Christian cross 56, as in FIGS. 1 through 4. The hollow religious ornament 12 can also be shaped as a Jewish star 58, as in FIGS. 5 and 6. Other types of hollow religious ornaments 12 and other types of hollow geometric shapes representing other things, such as religious, military and fraternal organizations can also be incorporated into the instant invention, to be used in funeral processions.

It will be understood that each of the elements described above, or two or more together may also find a useful application in other types of methods differing from the type described above.

While certain novel features of this invention are recited in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of identifying motor vehicles in a funeral procession comprising the steps of:

a) forming a hollow religious ornament containing a source of chemiluminescent light, said religious ornament comprising a longitudinal front portion fabricated out of a translucent material to allow light from said source of chemiluminescent light to pass therethrough and a longitudinal rear portion fabricated out of an opaque material to block the transmission of light, and a reflective material coating on the inside surface of said rear portion, said ornament including means to initiate illumination;

b) suspending one said ornament from a rearview mirror of each vehicle in said funeral procession with the front portion facing a windshield of each said vehicle to permit the light emanating from said ornament to be viewed through the windshield and blocking light to passengers within said vehicle; and c) initiating illumination by said source of chemiluminescent light by flexing said ornament.

2. The method of claim 1 in which said ornament is suspended from said rearview mirror by a ribbon which is adjustable in length.

3. The method of claim 2 in which a memorial sticker is applied to said rear portion to identify a deceased person in the funeral procession.

* * * * *